US005196021A

United States Patent [19]

Kabla

[11] Patent Number: 5,196,021

[45] Date of Patent: Mar. 23, 1993

[54] DEPILATORY DEVICE

[75] Inventor: Victor Kabla, Paris, France

[73] Assignee: Perfect Lady Ltd., Tikoa, Israel

[21] Appl. No.: 841,116

[22] Filed: Feb. 25, 1992

[51] Int. Cl.[5] ..... A45D 26/00

[52] U.S. Cl. ..... 606/133; 606/131; 452/82; 452/83; 452/84; 452/85; 452/75; 452/71

[58] Field of Search ..... 606/131, 133; 452/75, 452/71, 82-85

[56] References Cited

U.S. PATENT DOCUMENTS

| | | | |
|---|---|---|---|
| 2,592,484 | 4/1952 | Smith | 606/133 |
| 4,079,741 | 3/1978 | Daar et al. | 606/133 |
| 4,960,422 | 10/1990 | Demeester | 606/133 |
| 5,032,126 | 7/1991 | Cleyet et al. | 606/133 |
| 5,041,123 | 8/1991 | Oliveau et al. | 606/133 |
| 5,057,116 | 10/1991 | Zucker | 606/133 |
| 5,078,715 | 1/1992 | Daar et al. | 606/133 |
| 5,084,055 | 1/1992 | Demeester | 606/133 |
| 5,100,413 | 3/1992 | Doley | 606/133 |
| 5,100,414 | 3/1992 | Dolev | 606/133 |

FOREIGN PATENT DOCUMENTS

| | | | |
|---|---|---|---|
| 0147285 | 7/1985 | European Pat. Off. | 606/133 |

*Primary Examiner*—Stephen C. Pellegrino
*Assistant Examiner*—Glenn Dawson
*Attorney, Agent, or Firm*—Benjamin J. Barish

[57] ABSTRACT

A depilatory device for removing body hair, includes a pair of jaws adapted to sequentially traverse an opening in the housing when the hair-plucker body is driven by an electrical motor. The jaws of each pair are normally spaced apart in an open condition to receive a hair between them, but are movable towards each other to a closed condition to clamp the hair received between them. Camming elements carried by the housing move the pairs of jaws to their closed and open conditions as they sequentially traverse the housing opening.

19 Claims, 2 Drawing Sheets

FIG 3
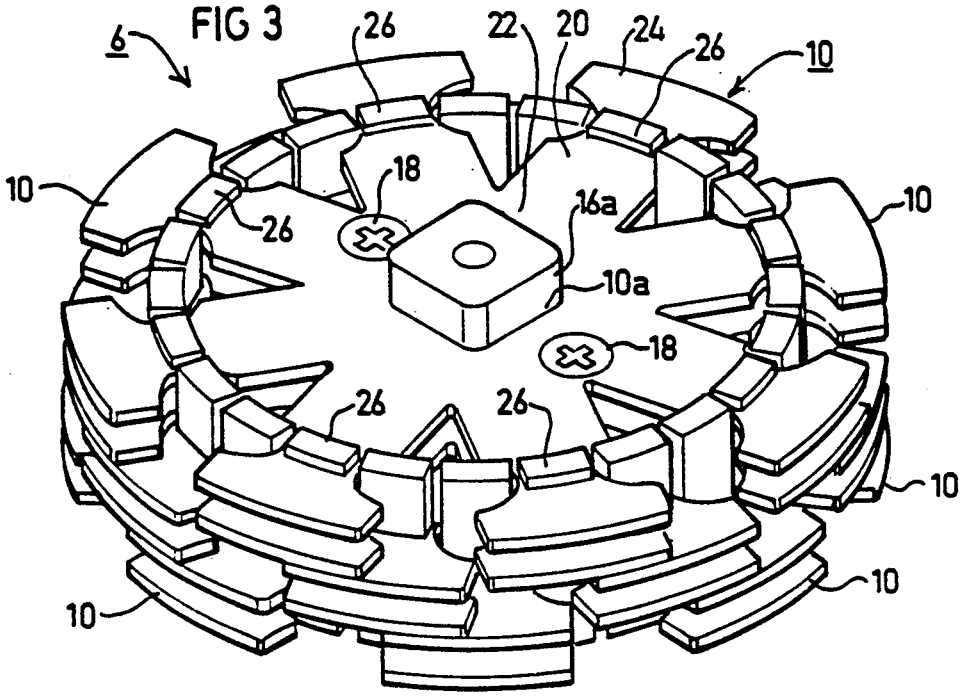
FIG 4
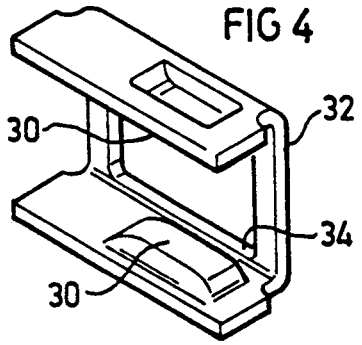
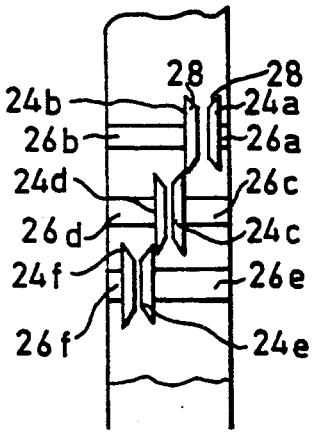
FIG 5
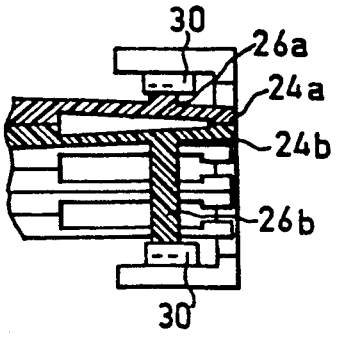
FIG 6a
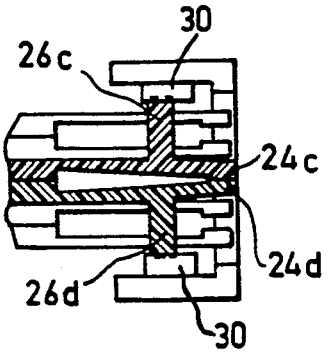
FIG 6b
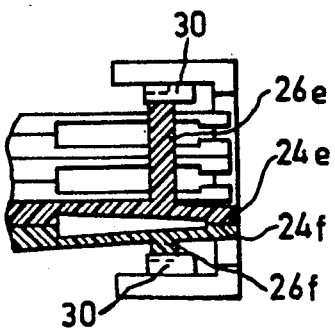
FIG 6c

DEPILATORY DEVICE

FIELD AND BACKGROUND OF THE INVENTION

The present invention relates to a depilatory device, namely to a device for removing body hair.

A number of depilatory devices are now commercially available. One type includes a helical spring which catches the hairs between the windings of the spring; and another type includes a plurality of discs which define gaps for catching and plucking the hair. A serious disadvantage of both of the foregoing types is that they tend to catch a bunch of hairs at one time. This can subject the user to considerable pain, and in fact many persons who have purchased such devices discontinue using them because of the pain.

OBJECTS AND BRIEF SUMMARY OF THE INVENTION

An object of the present invention is to provide another type of depilatory device which tends to catch fewer hairs at one time, thereby decreasing the pain caused in the use of the device.

According to the present invention, there is provided a depilatory device for removing body hair, comprising: a housing having an opening therein; an electrical motor within the housing; and a hair-plucker body coupled to the motor to be driven thereby for plucking hair via said opening. The hair-plucker body includes a plurality of pairs hair-plucker elements each formed with a plurality of jaws projecting from the outer edge of each element to define a plurality of pairs of jaws adapted to sequentially traverse said opening when the hair-plucker body is driven by the electrical motor. The jaws of each pair are normally spaced apart in an open condition to receive a hair between them, but are movable towards each other to a closed condition to clamp the hair received between them; and are angularly staggered with respect to the jaws of the other pairs of hair-plucker elements. The device further includes camming means carried by the housing for moving said pairs of jaws to said closed and open conditions as they sequentially traverse said housing opening.

According to further important features in the preferred embodiment of the invention described below, the hair-plucker body includes a plurality of pairs of hair-plucker elements, the camming means being effective to close and open each pair of jaws of the plurality of pairs of hair-plucker elements sequentially as the jaws traverse the housing opening.

According to further features in the described preferred embodiment, the hair-plucker elements are discs having a common rotary axis and are rotated by the electrical motor; in addition, each of the discs is formed with a plurality of radiating legs each terminating at its outer tip with one of the jaws. Each of the discs is further formed with with a hub portion of greater thickness than its radiating legs so as to normally space the jaws apart to their open condition, the radiating legs being deflectable by the camming means to move the jaws together to their closed condition.

According to another aspect of the invention, there is provided a depilatory device for removing body hair, comprising a housing having an opening therein; an electrical motor within the housing; and a hair-plucker body coupled to the motor to be rotated thereby for plucking hair via the opening. The hair-plucker body includes a plurality of discs having a common rotary axis. Each disc is formed with a plurality of radiating legs each terminating in an outer jaw such that each pair of adjacents discs defines a plurality of pairs of jaws adapted to sequentially traverse the opening when the hair-plucker body is driven by the electrical motor. The jaws of each pair are normally spaced apart in an open condition to receive a hair between them, but are movable towards each other to a closed condition to clamp the hair received between them. Projections fixed to the radiating legs and extending parallel to the common axis of the disc, are engageable with camming means carried by the housing for moving the pairs of jaws to the closed and open conditions as they sequentially traverse the housing opening.

As will be described more particularly below, a depilatory device constructed in accordance with the foregoing features tends to catch, in each pair of jaws, only one hair, or a fewer number of hairs, than the disc type or helical-spring type devices now commercially available, and is therefore inherently capable of subjecting the user to less pain.

Further features and advantages of the invention will be apparent from the description below.

BRIEF DESCRIPTION OF THE DRAWINGS

The invention is herein described, by way of example only, with reference to the accompanying drawings, wherein:

FIG. 3 is a perspective view of the hair-plucker body in the device of FIG. 1;

FIG. 4 illustrates the camming member in the device of FIG. 1;

FIG. 5 is an end elevational view illustrating the jaws in the device of FIG. 1; and FIGS. 6*a*, 6*b* and 6*c* illustrate the sequential operation of the jaws in the device of FIG. 1.

DESCRIPTION OF A PREFERRED EMBODIMENT

Figure 1:
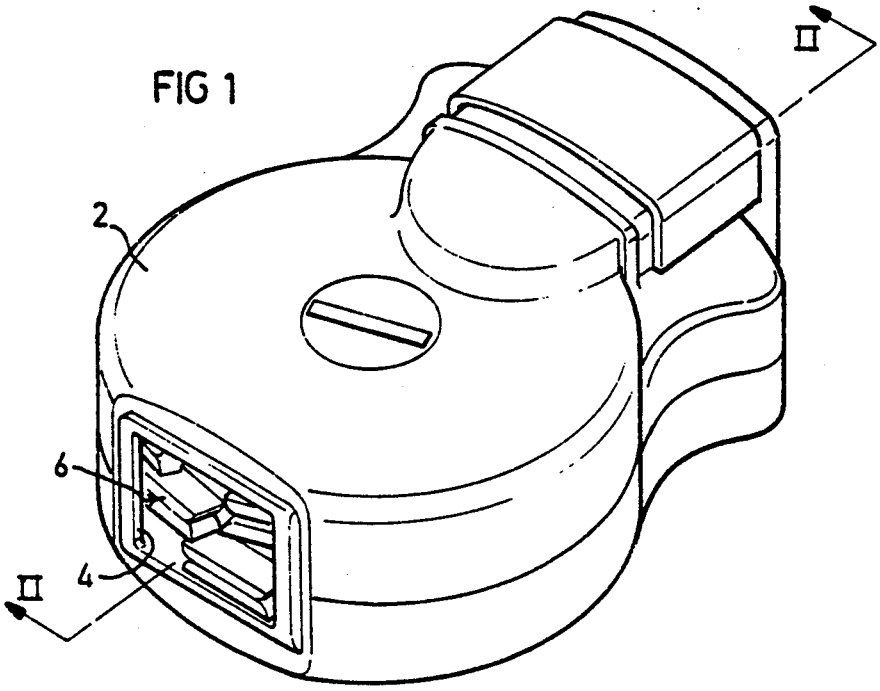
FIG. 1 illustrates one form of depilatory device constructed in accordance with the present invention.

The depilatory device illustrated in the drawings includes a housing 2 of a configuration to permit convenient gripping by a user. It is formed with a rectangular opening 4 at one end exposing a hair-plucker body, generally designated 6, located within the housing. The hair-plucker body is driven by an electric motor 8 (FIG. 2) also located within the housing.

Figure 2:
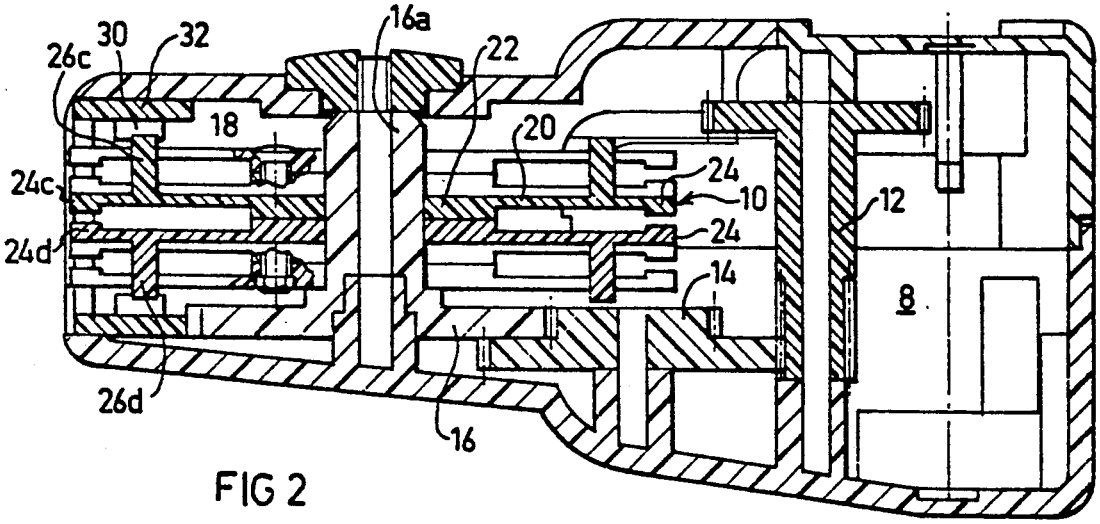
FIG. 2 is a longitudinal sectional view along line II—II of FIG. 1.

The hair-plucker body 6 is in the form of a stack of disc-like elements 10 rotated by electric motor 8 via gears 12, 14 and 16 (FIG. 2). The latter gear 16 is formed with a square hub 16*a* which is received within square openings 10*a* formed in the stack of elements 10 so as to rotate all the elements together. All the elements are secured together by a pair of fasteners 18.

As shown in FIGS. 2 and 3, each of the hair-plucker elements 10 is formed with a plurality of radiating legs 20 radiating from an inner hub 22 and each terminating at its outer tip in a jaw 24. The juncture of each radiating leg 20 with its jaw 24 is reduced in width and is formed with a rectangular projection 26.

Hair plucker body 6 illustrated in the drawings includes a stack of six hair-plucker elements 10 arranged in three pairs. Each pair of the hair-plucker elements 10 defines a plurality of pairs of jaws projecting from the outer edges of the elements. Thus, as shown particularly in FIG. 5, jaws 24a, 24b form one pair; jaws 24c, 24d form a second pair; and jaws 24e, 24f form a third pair. As also shown in FIG. 5, the three pairs of jaws are in staggered relationship around the circumference of the hair-plucker body 6.

In the example illustrated in the drawings, each hair-plucker element 10 is formed with eight radiating legs, so that their center lines are separated by 45°. In addition, there are three pairs of elements 10, and therefore three pairs of jaws for each 45° sector. Thus, the center lines between the pairs of jaws are staggered 15°.

As also seen in FIG. 3, the spaces between the radiating legs 20 of the hair-plucker elements 10 are at a maximum at the junctures between the radiating legs and their respective jaws 24. Thus, the spaces between the radiating legs 20 of one element 10 are sufficient to accommodate the projections 26 of the other two pairs of elements 10. The projections 26 of all three pairs of elements 10 are disposed in a circular array.

Projections 26 are of different lengths so that they all terminate flush with each other on opposite sides of the hair-plucker body 6. Thus, as shown in FIG. 5, projections 26a and 26f of jaws 24a and 24f, respectively, are of short length; projections 26c and 26d of jaws 24c and 24d are of medium length; and projections 26b and 26e of jaws 24b and 24e are of long length.

These projections 26a–26f, whose outer surfaces terminate flush with each other on opposite sides of the hair-plucker body 6, cooperate with a pair of cam elements carried by the housing 2 so as to sequentially close and open the three pairs of jaws in each 45° sector as the hair-plucker body 6 is rotated. The cam elements engaging the projections 26a–26f are shown at 30 in FIG. 4. These cam elements 30 are integrally formed with a frame member 32 having a rectangular opening 34 aligned with, and framing, the rectangular opening 4 in housing 2.

As also seen in FIG. 5, the jaws 24 are also formed with convergingly tapered surfaces 28 from their leading edges inwardly thereof, so as to direct the hairs to be received between the jaws when the jaws are open.

The illustrated device operates as follows:

When the electric motor 8 is not operating, the hub portions 22 of the hair-plucker elements 10 in the hair-plucker body 6 abut each other, as shown in FIG. 2, and thereby normally maintain the jaws 24 at the ends of their radiating legs 20 in a spaced-apart, or open, condition. However, one pair of jaws 24 may have their projections 26 engaged by the cam elements 30 of the frame member 32 within the housing opening 4, and therefore may be closed.

When the device is to be used for removing hair, the electric motor 8 is energized, and the housing is manipulated to cause its opening 4 to move across the skin having the hair to be plucked. As the hair-plucker body 6 is rotated by electric motor 8, the cam elements (FIG. 4) on opposite sides of opening 4 sequentially engage the projections 26 of the hair-plucker elements 10 so as to sequentially close and open their jaws 24.

FIG. 6a illustrates the condition wherein the cam elements 30 engage the short projection 26a of jaw 24a and the long projection 26b of jaw 24b so as to close jaws 24a, 24b at that instant. As the hair-plucker body 6 continues to rotate across housing opening 4, cam elements 30 disengage from projections 26a, 26b, and engage projections 26c, 26d, thereby permitting jaws 24a, 24b to open while closing jaws 24c, 24d (FIG. 6b). Continued rotation of the hair- plucker body 6 causes the cam elements 30 to disengage from projections 26c, 26d and to engage projections 26e, 26f of jaws 24e, 24f, to thereby permit jaws 24c, 24d to open and to close jaws 24e, 24f (FIG. 6c).

It will thus be seen that as the hair-plucker body 6 is rotated by electric motor 4, the three pairs of jaws in each 45° sector of the assembly will be sequentially closed and opened so as to sequentially catch, pluck and release hairs received within the open jaws. Since the illustrated construction tends to catch, at one time in each pair of jaws, only a single hair, or a few hairs, there is less likelihood of causing pain than in the known constructions including discs and helical springs wherein bunches of hair tend to be caught at one time.

While the invention has been described with respect to one preferred embodiment, it will be appreciated that this is set forth merely for purposes of example, and that many variations may be made. For example, the cam elements 30 could be rollers or balls in order to decrease friction. Instead of forming the openable-closable jaws in rotatable disc-like elements, they could be formed in reciprocatory slide-like elements. Many other variations, modifications and applications of the invention will be apparent.

What is claimed is:

1. A depilatory device for removing body hair, comprising: a housing having an opening therein; an electrical motor within the housing; a hair-plucker body coupled to the motor to be driven thereby for plucking hair via said opening; said hair-plucker body including a plurality of pairs of hair-plucker elements each formed with a plurality of jaws projecting from an outer edge of each element to define a plurality of pairs of jaws adapted to sequentially traverse said opening when the hair-plucker body is driven by the electrical motor; the jaws of each pair of being normally spaced apart in an open condition to receive a hair between them, but being movable towards each other to a closed condition to clamp the hair received between them; the jaws of each pair of hair-plucker elements being angularly staggered with respect to the jaws of the other pairs of hair-plucker elements; and camming means carried by said housing for sequentially moving said pairs of jaws to said closed and open conditions as they sequentially traverse said housing opening.

2. The device according to claim 1, wherein said hair-plucker elements are discs having a common rotary axis rotated by said electrial motor.

3. The device according to claim 2, wherein each of said discs is formed with a plurality of radiating legs each terminating at an outer tip with one of said jaws.

4. The device according to claim 3, wherein each of said discs is further formed with a hub portion of greater thickness than its radiating legs so as to normally space the jaws apart to their open condition, said radiating legs being deflectable by said camming means to move the jaws together to their closed condition.

5. The device according to claim 4, wherein said camming means comprises cam elements carried by said housing on opposite sides of the housing opening and engageable by projections formed on each of said radiating legs just inwardly of each jaw.

6. The device according to claim 5, wherein said cam elements are carried on the opposite sides of a frame member framing said housing opening.

7. The device according to claim 5, wherein said projections on the legs of one pair of discs are located in spaces between the legs of the remaining pairs of discs.

8. The device according to claim 7, wherein said projections are disposed in a circular array and are of different lengths, depending on the distance of the respective jaw from said cam elements carried by the housing.

9. The device according to claim 1, wherein each of said jaws is formed with a convergingly tapered surface from its leading edge inwardly thereof.

10. The device according to claim 1, wherein said hair-plucker body includes at least three pairs of hair-plucker elements.

11. The device according to claim 10, wherein each pair of hair-plucker elements includes at least eight jaws, the jaws of each pair of hair-plucker elements being staggered with respect to the jaws of the other pairs of hair-plucker elements.

12. The device according to claim 10, wherein said hair-plucker elements are discs rotated by said electrical motor.

13. The device according to claim 12, wherein each of said discs is formed with a plurality of radiating legs each terminating at its outer tip with one of said jaws.

14. The device according to claim 13, wherein each of said discs is further formed with a hub portion of greater thickness than its radiating legs so as to normally space the jaws apart to their open condition, said radiating legs being deflectable by said camming means to move the jaws together to their closed condition.

15. A depilatory device for removing body hair, comprising: a housing having an opening therein; an electrical motor within the housing; a hair-plucker body coupled to the motor to be rotated thereby for plucking hair via said opening; said hair-plucker body including a plurality of pairs of discs, said discs having a common rotary axis; each of said discs being formed with a plurality of radiating legs each terminating in an outer jaw such that each pair of adjacent discs defines a plurality of pairs of jaws adapted to sequentially traverse said opening when the hair-plucker body is driven by the electrical motor; the jaws of each pair being normally spaced apart in an open condition to receive a hair between them, but being movable towards each other to a closed condition to clamp the hair received between them; projections fixed to said radiating legs and extending parallel to said common axis of the discs and camming means carried by said housing and engageable with said projections for moving said pairs of jaws to said closed and open conditions as they sequentially traverse said housing opening.

16. The device according to claim 15, wherein each of said discs is formed with a hub portion of greater thickness than its radiating legs so as to normally space the jaws apart to their open condition, said radiating legs being deflectable by said camming means to move the jaws together to their closed condition.

17. The device according to claim 16, wherein said camming means comprises cam elements carried on the opposite sides of a frame member framing said housing opening.

18. The device according to claim 15, wherein the jaws of each pair of said discs are angularly staggered with respect to the jaws of the other pairs of discs.

19. The device according to claim 15, wherein said projections, on the legs of one pair of discs are located in spaces between the legs of the remaining paris of discs, said projections being disposed in a circular array so that they all terminate flush with each other on opposite sides of the hair-plucker body.

* * * * *